US011149369B2

(12) United States Patent
Yamanashi et al.

(10) Patent No.: US 11,149,369 B2
(45) Date of Patent: Oct. 19, 2021

(54) SEWING MACHINE AND SEWING MACHINE CONTROL METHOD

(71) Applicant: BROTHER KOGYO KABUSHIKI KAISHA, Nagoya (JP)

(72) Inventors: Yoko Yamanashi, Konan (JP); Yukiyoshi Muto, Nagoya (JP); Takafumi Naka, Ama (JP); Fuyuki Nakashima, Ibi-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 81 days.

(21) Appl. No.: 16/751,928

(22) Filed: Jan. 24, 2020

(65) Prior Publication Data

US 2020/0291561 A1 Sep. 17, 2020

(30) Foreign Application Priority Data

Mar. 11, 2019 (JP) ..... JP2019-043755

(51) Int. Cl.
*D05B 53/00* (2006.01)
*D05B 19/16* (2006.01)
(Continued)

(52) U.S. Cl.
CPC ..... *D05B 53/00* (2013.01); *D05B 19/16* (2013.01); *D05B 27/00* (2013.01); *D05B 69/12* (2013.01); *D05D 2209/16* (2013.01)

(58) Field of Classification Search
CPC ..... D05D 2209/16; D05D 2303/02; D05D 2303/08; D05B 27/00; D05B 69/12;
(Continued)

(56) References Cited

U.S. PATENT DOCUMENTS 3,511,201 A 5/1970 Howell
4,136,626 A 1/1979 Kandou et al.
(Continued)

FOREIGN PATENT DOCUMENTS

JP 2006-158981 A 6/2006
JP 2017-55876 A 3/2017
JP 3210359 U 5/2017

OTHER PUBLICATIONS

U.S. Appl. No. 16/751,923, filed Jan. 24, 2020 in the name of Midori Komada et al.
Jul. 8, 2021 Office Action issued in U.S. Appl. No. 16/751,923.

*Primary Examiner* — Nathan E Durham
(74) *Attorney, Agent, or Firm* — Oliff PLC

(57) ABSTRACT

A sewing machine includes a movement mechanism, a swinging mechanism, a presser device, a guide portion, a processor, and a memory configured to store computer-readable instructions that, when executed by the processor, instruct the processor to perform processes. The processes include acquiring pattern data used for sewing a couching pattern in which a plurality of motifs are continuously arranged. The motif is configured in a predetermined shape by a plurality of stitches including a main stitch and a sub-stitch. The processes include correcting at least one selected from the group of a start point position and an end point position of the main stitch of one of the motifs, such that the length of the main stitch of the one motif is longer in a second case than in a first case, and driving the movement mechanism and the swinging mechanism in accordance with the corrected pattern data.

14 Claims, 10 Drawing Sheets

(51) Int. Cl.
*D05B 69/12* (2006.01)
*D05B 27/00* (2006.01)

(58) Field of Classification Search
CPC ..... D05B 19/08; D05B 19/10; D05B 19/12; D05B 19/16; D05B 53/00
USPC ..... 700/136–138
See application file for complete search history.

(56) References Cited

U.S. PATENT DOCUMENTS

| | | | | |
|---|---|---|---|---|
| 5,050,514 | A | 9/1991 | Niederkorn | |
| 5,054,407 | A | 10/1991 | Rowley | |
| 2015/0090168 | A1* | 4/2015 | Kobayashi | D05B 53/00 112/470.03 |
| 2015/0094842 | A1* | 4/2015 | Kobayashi | D05B 19/14 700/137 |
| 2017/0073866 | A1 | 3/2017 | Okada | |

* cited by examiner

SEWING MACHINE AND SEWING MACHINE CONTROL METHOD

CROSS-REFERENCE TO RELATED APPLICATION

This application claims priority to Japanese Patent Application No. 2019-043755 filed Mar. 11, 2019, the content of which is hereby incorporated herein by reference in its entirety.

BACKGROUND

The present disclosure relates to a sewing machine and a sewing machine control method.

A presser device is known that is suitable for couching, in which a pattern is drawn on a sewing object, by stitching a cord, such as wool, a decorative thread, a ribbon and the like, to the sewing object. The presser device is provided with a presser main body and a cover member. The presser main body is provided with an attachment portion, a support portion, and a presser portion. The attachment portion is mounted on a presser bar of a sewing machine. The support portion extends downward from the attachment portion. The presser portion forms an insertion hole including a string guide groove for inserting the cord into a lower end of the presser portion. The cover member is provided with a groove covering portion and a support plate portion. The groove covering portion traverses and covers the string guide groove. The support plate portion is contiguous to the groove covering portion and is formed along the support portion.

SUMMARY

In the known presser device described above, tension applied to the cord may differ depending on a direction in which the cord is supplied to the insertion hole, and on a feeding direction of the sewing object. As the tension applied to the cord becomes larger, the cord becomes thinner, and as the tension applied to the cord becomes smaller, the cord becomes thicker. Thus, in the known presser device, a phenomenon occurs in which, depending on the direction in which the cord is supplied to the insertion hole, and on the feeding direction of the sewing object, there are variations in the thickness of the cord, and the cord cannot be stitched to the sewing object.

Embodiments of the broad principles derived herein provide a sewing machine and a sewing machine control method capable of reducing variations in a thickness of a cord depending on a direction in which the cord is supplied to an insertion hole and on a feeding direction of a sewing object, and capable of improving a possibility of stitching the cord to the sewing object, in comparison to related art.

Embodiments provide a sewing machine that includes a movement mechanism, a swinging mechanism, a presser device, a guide portion, a processor, and a memory. The movement mechanism is configured to move a sewing object in a first direction and a second direction orthogonal to the first direction. The swinging mechanism includes a needle bar having a lower end on which a sewing needle is mountable, and is configured to swing the needle bar in a third direction orthogonal to the first direction and the second direction. The presser device includes an insertion hole through which the sewing needle is insertable. The guide portion is configured to guide a cord to the insertion hole from one side in the first direction. The processor is configured to control the movement mechanism and the swinging mechanism. The memory is configured to store computer-readable instructions that, when executed by the processor, instruct the processor to perform processes. The processes include acquiring pattern data that is used for sewing a couching pattern in which the cord inserted through the insertion hole is stitched to the sewing object, and that represents positions of a plurality of needle drop points. The couching pattern is a pattern in which a plurality of motifs are continuously arranged. The motif is configured in a predetermined shape by a plurality of stitches including a main stitch and a sub-stitch. The main stitch has a longest length from among the plurality of stitches of the motif. The sub-stitch has a length shorter than that of the main stitch and extending in a direction intersecting the main stitch. The pattern data is represented using a coordinate system of the movement mechanism in the first direction and the second direction. The processes includes correcting at least one selected from the group of a start point position and an end point position of the main stitch of one of the motifs included in the pattern data, such that the length of the main stitch of the one motif, among the plurality of motifs represented by the acquired pattern data, is longer in a second case than in a first case. The first case is a case in which the end point position is a position obtained by moving the sewing object from the start point position toward another side in the first direction with respect to the needle bar. The second case is a case in which the end point position is a position obtained by moving the sewing object from the start point position toward the one side in the first direction with respect to the needle bar. The processes include driving the movement mechanism and the swinging mechanism in accordance with the corrected pattern data to sew the couching pattern.

Embodiments further provide a sewing machine control method for a sewing machine including a movement mechanism configured to move a sewing object in a first direction and a second direction orthogonal to the first direction, a swinging mechanism including a needle bar having a lower end on which a sewing needle is mountable, and configured to swing the needle bar in a third direction orthogonal to the first direction and the second direction, a presser device including an insertion hole through which the sewing needle is insertable, a guide portion configured to guide a cord to the insertion hole from one side in the first direction, and a processor configured to control the movement mechanism and the swinging mechanism. The sewing machine control method includes the steps. The steps includes acquiring pattern data that is used for sewing a couching pattern in which the cord inserted through the insertion hole is stitched to the sewing object, and that represents positions of a plurality of needle drop points. The couching pattern is a pattern in which a plurality of motifs are continuously arranged. The motif is configured in a predetermined shape by a plurality of stitches including a main stitch and a sub-stitch. The main stitch has a longest length from among the plurality of stitches of the motif. The sub-stitch has a length shorter than that of the main stitch and extending in a direction intersecting the main stitch. The pattern data is represented using a coordinate system of the movement mechanism in the first direction and the second direction. The steps include correcting at least one selected from the group of a start point position and an end point position of the main stitch of one of the motifs included in the pattern data, such that the length of the main stitch of the one motif, among the plurality of motifs represented by the acquired pattern data, is longer in a second case than in a first case.

The first case is a case in which the end point position is a position obtained by moving the sewing object from the start point position toward another side in the first direction with respect to the needle bar. The second case is a case in which the end point position is a position obtained by moving the sewing object from the start point position toward the one side in the first direction with respect to the needle bar. The steps include driving the movement mechanism and the swinging mechanism in accordance with the corrected pattern data to sew the couching pattern.

BRIEF DESCRIPTION OF THE DRAWINGS

Embodiments will be described below in detail with reference to the accompanying drawings in which.

DETAILED DESCRIPTION

Figure 1:
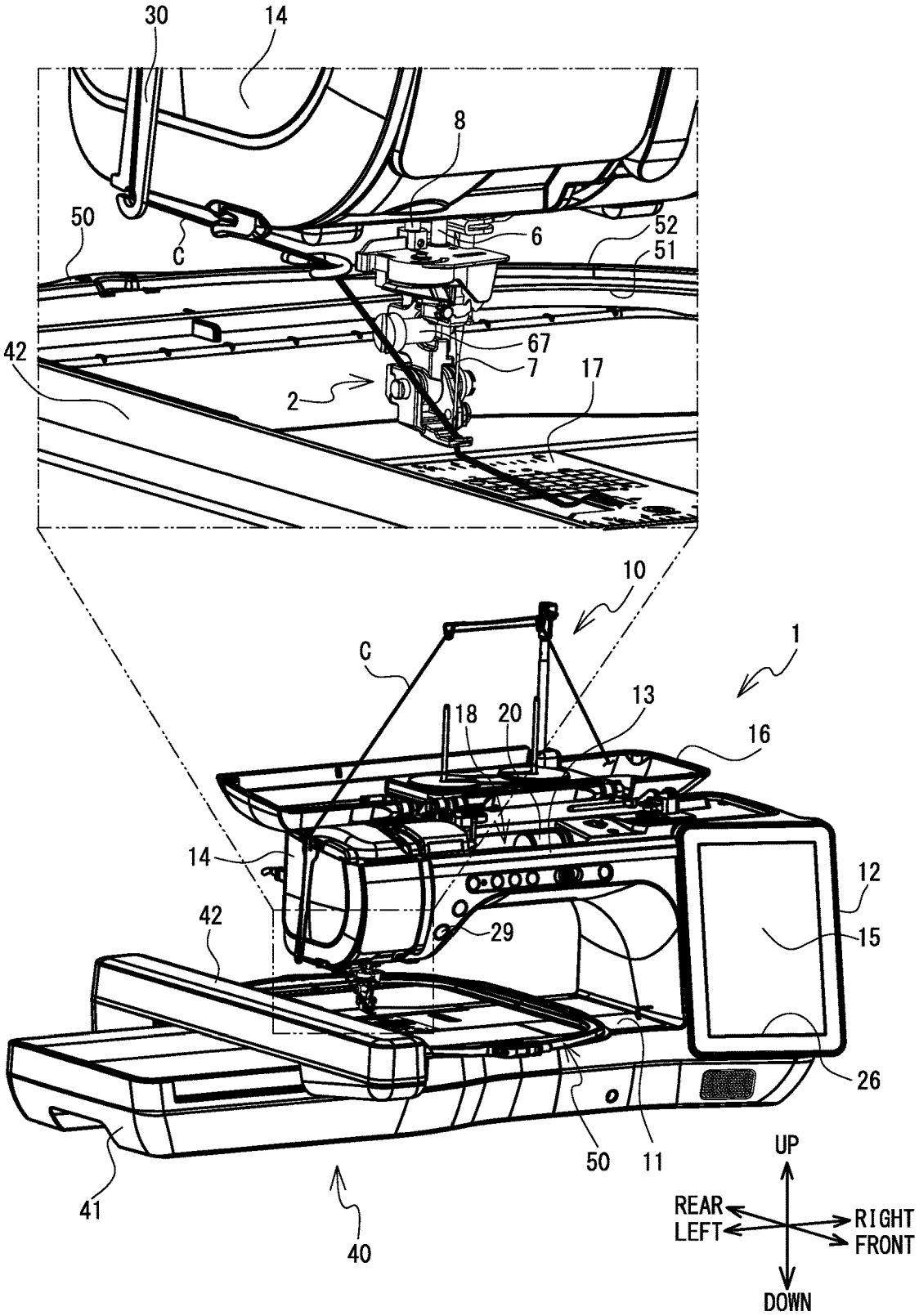
FIG. 1 is a perspective view of a sewing machine on which a presser device and a movement mechanism are mounted.

An embodiment of the present disclosure will be explained with reference to the drawings. A physical configuration of a sewing machine 1 on which a presser device 2 and a movement mechanism 40 are mounted will be explained with reference to FIG. 1. The up-down direction, the lower right side, the upper left side, the lower left side and the upper right side of FIG. 1 respectively correspond to the up-down direction, the front side, the rear side, the left side and the right side of the sewing machine 1 on which the presser device 2 and the movement mechanism 40 are mounted. The longitudinal direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 is provided so as to extend upward from the right end portion of the bed portion 11. The arm portion 13 faces the bed portion 11 and extends to the left from the upper end of the pillar 12. The head portion 14 is coupled to the left leading end portion of the arm portion 13.

Figure 3:
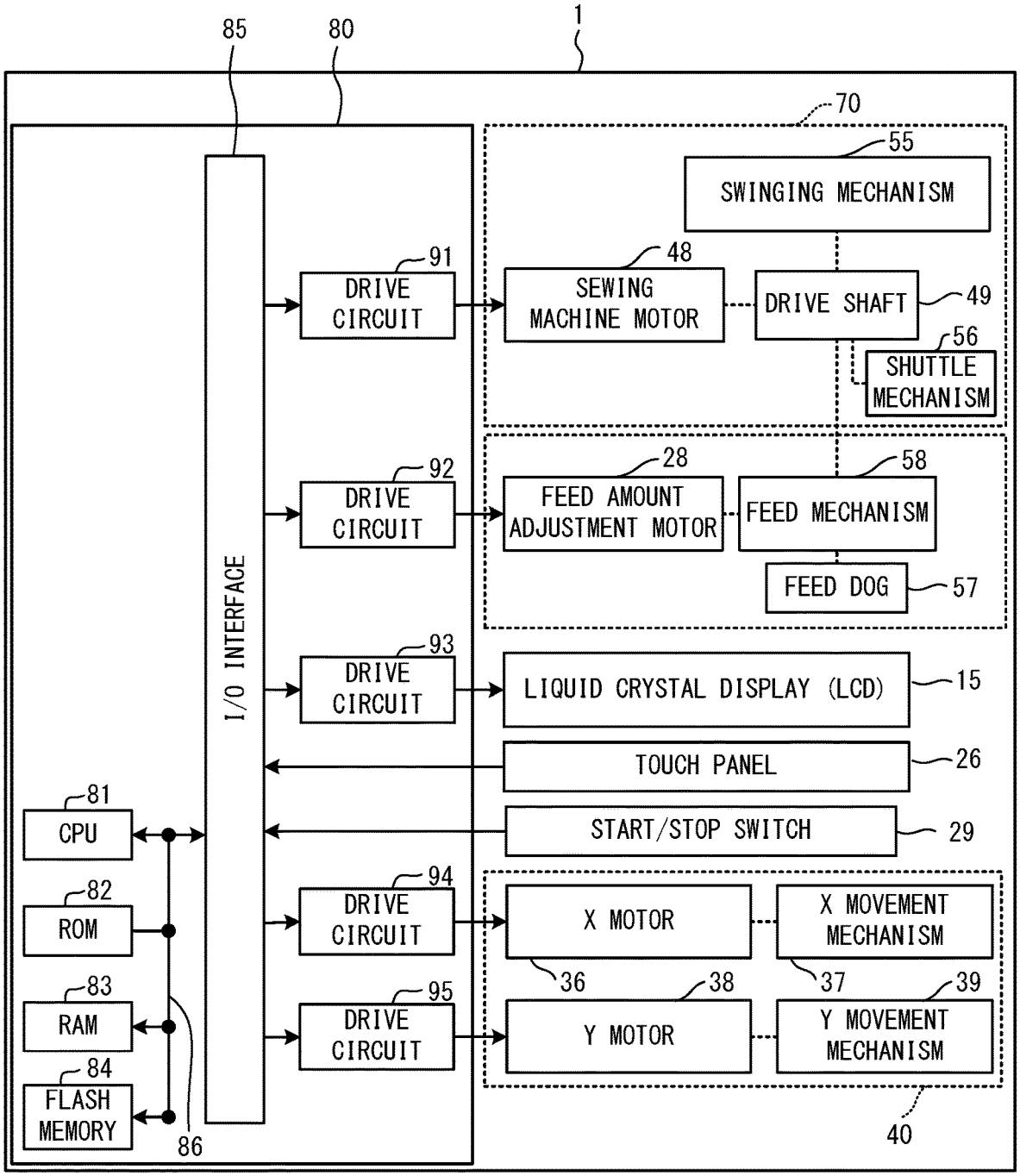
FIG. 3 is a block diagram showing an electrical configuration of the sewing machine.

A feed dog 57, a feed mechanism 58, a shuttle mechanism 56 and the like, which are shown in FIG. 3 are provided inside the bed portion 11 of the sewing machine 1. When normal sewing that is not embroidery sewing is performed, the feed dog 57 is driven by the feed mechanism 58 and moves a sewing object by a predetermined movement amount. The shuttle mechanism 56 entwines an upper thread (not shown in the drawings) with a lower thread (not shown in the drawings) below a needle plate 17 that is provided on an upper surface of the bed portion 11. Together with a sewing machine motor 48, a drive shaft 49, and a swinging mechanism 55 to be described later, the shuttle mechanism 56 configures a sewing portion 70 configured to form stitches on the sewing object.

An LCD 15 is provided in the front surface of the pillar 12. The LCD 15 displays a screen including various items, such as commands, illustrations, setting values, messages, and the like. A touch panel 26, which can detect a depressed position, is provided on the front surface side of the LCD 15. When a user performs a pressing operation on the touch panel 26, using a finger or a stylus pen (not shown in the drawings), the touch panel 26 detects the depressed position. A control portion 80 (refer to FIG. 3) of the sewing machine 1 detects a selected item on an image, on the basis of the detected depressed position. The sewing machine motor 48 is provided inside the pillar 12.

An upper portion of the arm portion 13 is provided with a cover 16 that can open and close. FIG. 1 shows the sewing machine 1 when the cover 16 is in an open state. When the cover 16 is in a closed state, a thread housing portion 18 is provided below the cover 16 (namely, inside the arm portion 13). The thread housing portion 18 can house a thread spool 20 around which the upper thread is wound. When the cover 16 is in the open state, a thread spool device 10 can be detachably mounted. The thread spool device 10 can hold two thread spools, and can also guide the upper thread supplied from each of the thread spools toward a sewing needle 7 of the sewing machine 1. When sewing a couching pattern, the thread spool device 10 can guide a cord C, such as wool or a decorative braid, from a supply source (not shown in the drawings) of the cord C toward the presser device 2. The supply source of the cord C is, for example, a roll or the like on which the cord C is wound, and the supply source is disposed to the right of the thread housing portion 18 when the cover 16 is in the open state, or in the vicinity of the sewing machine 1. The drive shaft 49 (refer to FIG. 3), which extends in the left-right direction, is provided inside the arm portion 13. The drive shaft 49 is driven to rotate by the sewing machine motor 48. Various switches, including a start/stop switch 29, are provided on a lower left portion of the front surface of the arm portion 13. The start/stop switch 29 starts or stops the operation of the sewing machine 1, namely, is used to input a sewing start command or a sewing stop command.

The head portion 14 is provided with a needle bar 6, the swinging mechanism 55 (refer to FIG. 3), a presser bar 8, and the like. The needle bar 6 extends in the up-down direction. The sewing needle 7 is detachably mounted on the lower end of the needle bar 6. The swinging mechanism 55 drives the needle bar 6 in the up-down direction as a result of the rotation of the drive shaft 49. The presser bar 8 extends in the up-down direction to the rear of the needle bar 6. The presser device 2 is detachably attached to the lower end portion of the presser bar 8. When embroidery sewing is performed using an embroidery frame 50, the presser device 2 intermittently presses the sewing object in synchronization with the up-down movement of the needle bar 6. The presser device 2 will be described in more detail later. When the cover 16 is in the open state, a guide member 30 is detachably mounted on the left side of the head portion 14. The guide member 30 extends in the up-down direction, and can guide the cord C toward the presser device 2.

The movement mechanism 40 is detachably mounted on the bed portion 11 of the sewing machine 1. The movement mechanism 40 is provided with a main body portion 41, a carriage 42, and a holder. An X movement mechanism 37 and an X motor 36 shown in FIG. 3 are provided inside the main body portion 41. The X movement mechanism 37 is configured to move the carriage 42 in the left-right direction (an X direction). The X motor 36 drives the X movement mechanism 37. The carriage 42 is configured to move in the left-right direction with respect to the main body portion 41. The carriage 42 is provided with a Y movement mechanism 39 and a Y motor 38 shown in FIG. 3. The Y movement mechanism 39 is configured to move the holder in the front-rear direction (a Y direction). The Y motor 38 drives the Y movement mechanism 39. The holder is supported, to the right of the carriage 42, so as to be able to move in the front-rear direction with respect to the carriage 42. The embroidery frame 50 that is configured to hold the sheet-shaped sewing object (a work cloth, for example) is detachably mounted on the holder. The embroidery frame 50 is provided with a first frame 51 and a second frame 52, and is configured to clamp the sewing object between the first frame 51 and the second frame 52. In the embroidery sewing using the embroidery frame 50, the movement mechanism 40 can move the embroidery frame 50 mounted on the holder of the carriage 42 to a position indicated by a unique XY coordinate system (an embroidery coordinate system). In the embroidery coordinate system, for example, the right side, the left side, the rear side, and the front side of the sewing machine 1 are, respectively, a positive X direction, a negative X direction, a positive Y direction, and a negative Y direction.

Figure 2:
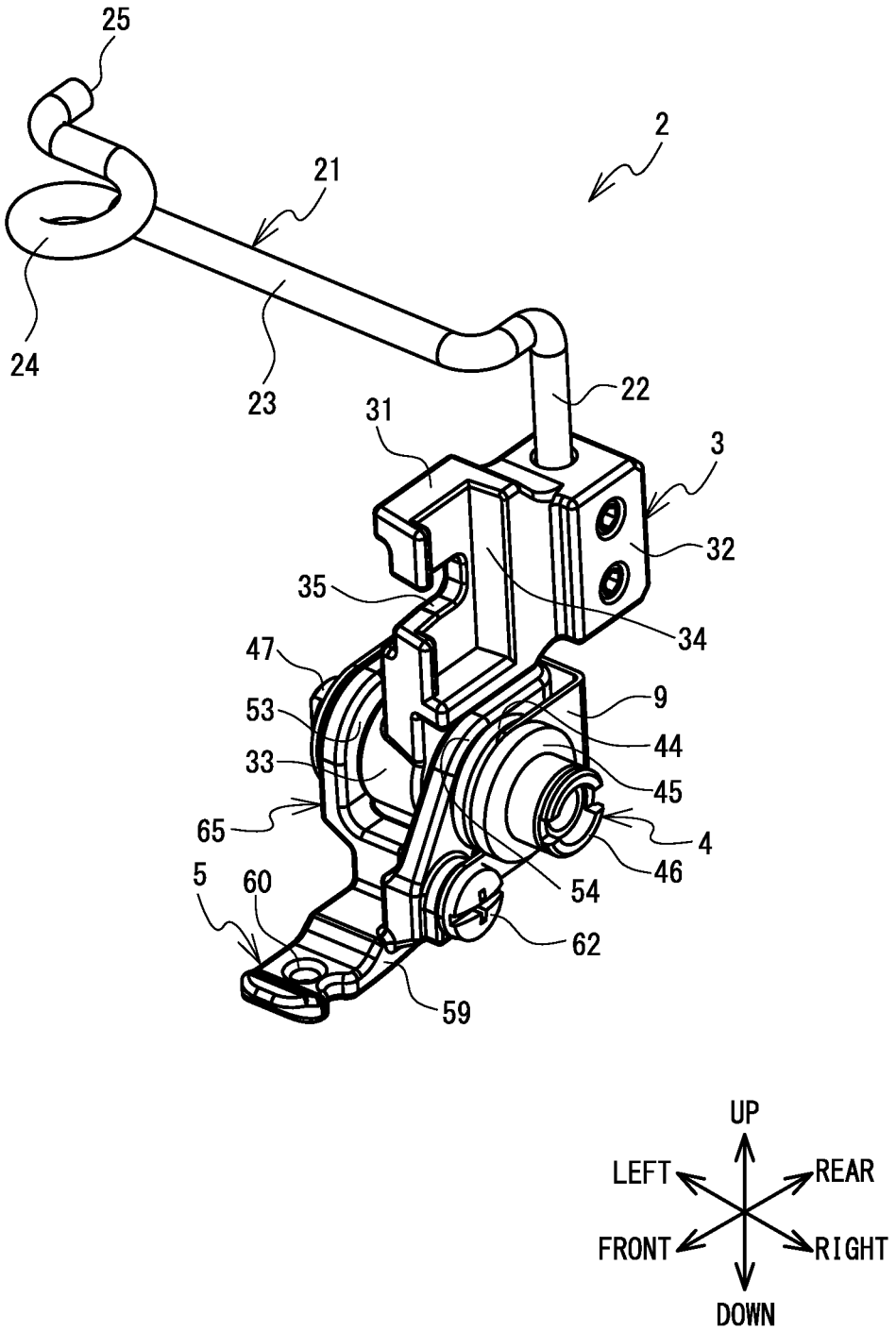
FIG. 2 is a perspective view of the presser device.

The presser device 2 will be explained with reference to FIG. 2. The presser device 2 is a metal presser device that is used when sewing the couching pattern using the embroidery frame 50 mounted on the movement mechanism 40. The presser device 2 is provided with an attachment body 3, an adjustment member 4, and a presser body 5. The presser device 2 is further provided with a suppression body 9 and a rotation stopper member (not shown in the drawings).

The attachment body 3 is provided with an attachment portion 31, support portions 32 and 33, a guide 21, and a shaft 47. The attachment portion 31 is attached to the presser bar 8 that is provided on the sewing machine 1 and that extends in the up-down direction. The attachment portion 31 extends in the up-down direction and includes recessed portions 34 and 35. The recessed portion 34 is a portion that is recessed to the left from a right end portion of the attachment portion 31. The recessed portion 34 extends to the upper end of the attachment portion 31. The recessed portion 35 is a portion that is recessed to the rear from a front end of the attachment portion 31, in the vicinity of substantially the center of the attachment portion 31 in the up-down direction. The recessed portion 35 is communicated with the recessed portion 34. In a state in which the presser bar 8 is disposed in the recessed portion 34, the presser device 2 is detachably mounted on the presser bar 8 by tightening a screw 67 (refer to FIG. 1) that is inserted through the recessed portion 35 and extends in the left-right direction into a screw hole provided in the presser bar 8. The support portion 32 is a cuboid shape that extends in the front-rear direction, to the rear of the attachment portion 31. The support portion 32 supports the guide 21, in a state in which the lower end of the guide 21 is inserted through a hole that is recessed downward from the upper end of the support portion 32.

With respect to an insertion hole 60 of the presser body 5 to be described later, the guide 21 can guide the cord C to the insertion hole 60 from the left. The guide 21 is a member formed by bending a rod shaped metal member, and is provided with a mounting portion 22, a support portion 23, and a loop portion 24. The mounting portion 22 extends in the up-down direction. The lower end of the mounting portion 22 is supported by the support portion 32. The support portion 23 is a portion that extends in the left-right direction. The loop portion 24 is a portion that is bent in a circular shape in the counterclockwise direction in a plan view from the right end of the loop portion 24. In the up-down direction, another end 25 of the loop portion 24 is positioned higher than the support portion 23. The loop portion 24 is positioned to the left and slightly to the rear of the insertion hole 60. When sewing the couching pattern, the cord C is inserted through a hole surrounded by the loop portion 24. In a plan view, a length in the front-rear direction between the center of the circle surrounded by the loop portion 24 and the center of the insertion hole 60 of the presser body 5 is shorter than a length in the left-right direction between the center of the circle surrounded by the loop portion 24 and the center of the insertion hole 60 of the presser body 5. The shaft 47 is a rod-shaped member that extends in left-right direction intersecting the front-rear direction.

The adjustment member 4 is screwed together with the right end side of the shaft 47. In a state in which a relative position in the left-right direction between the presser body 5 and the adjustment member 4 is maintained at the same position, a relative position in the left-right direction between the shaft 47 of the attachment body 3 and the adjustment member 4 changes in accordance with the rotation of the adjustment member 4. The adjustment member 4 includes a first wall portion 44, a second wall portion 45, and an engagement portion 46. The adjustment member 4 engages with the suppression body 9 to be described later, between the first wall portion 44 and the second wall portion 45. The engagement portion 46 is provided on the right end of the adjustment member 4. The engagement portion 46 is disposed on the right side of the second wall portion 45, and has a groove that is configured to be engaged with a jig used to rotate the adjustment member 4.

The presser body 5 is configured to move along the shaft 47 in the left-right direction with respect to the attachment body 3, in accordance with the rotation of the adjustment member 4. The presser body 5 is provided with a mounting portion 65 and a presser portion 59. The mounting portion 65 is a portion used to mount the presser body 5 on the attachment body 3. The mounting portion 65 includes a left wall 53, a right wall 54, and a rear wall. The left wall 53 and the right wall 54 include insertion portions that penetrate in the left-right direction and through which the shaft 47 is inserted. In a state in which the shaft 47 is inserted through the insertion portions of the left wall 53 and the right wall 54, the support portion 33 of the attachment body 3 is disposed between the left wall 53 and the right wall 54.

The presser portion 59 extends to the front from the lower front side of the mounting portion 65. The presser portion 59 has the insertion hole 60. The insertion hole 60 is a through hole that is circular in a plan view and is provided in a front end portion of the presser portion 59. The sewing needle 7 mounted on the lower end of the needle bar 6, and the cord C that has passed through the loop portion 24 of the guide 21 are inserted through the insertion hole 60. The position of the insertion hole 60 in the left-right direction with respect to the presser bar 8 (the attachment body 3) can be adjusted using the adjustment member 4. The suppression body 9 comes into contact with the adjustment member 4 and suppresses the rotation of the adjustment member 4. The suppression body 9 engages with the adjustment member 4 between the first wall portion 44 and the second wall portion 45. The suppression body 9 is fixed to the presser body 5 using a screw 62. Specifically, the adjustment member 4 is rotatably fixed to the presser body 5 via the suppression body 9. A rotation stopper member is connected to the attachment body 3 and regulates the rotation of the presser body 5 around the shaft 47. The rotation stopper member is a pin that extends in the front-rear direction, and is connected to the attachment body 3 from the rear side of the attachment body 3.

An electrical configuration of the sewing machine 1 will be explained with reference to FIG. 3. The control portion 80 of the sewing machine 1 is provided with a CPU 81, a ROM 82, a RAM 83, a flash memory 84, an input/output (I/O) interface 85, and drive circuits 91 to 95. The CPU 81 is connected to the ROM 82, the RAM 83, the flash memory 84 and the I/O interface 85, via a bus 86.

The CPU 81 performs main control of the sewing machine 1, and performs various arithmetic computing and processing related to sewing, in accordance with various programs stored in the ROM 82. Although not shown in the drawings, the ROM 82 is provided with a plurality of storage areas including a program storage area. The various programs (a program for executing main processing to be described later, for example) that are used to operate the sewing machine 1 are stored in the program storage area. A storage area for storing computation results and the like resulting from the arithmetic processing is provided in the RAM 83. Various parameters and the like used by the sewing machine 1 to perform various processing are stored in the flash memory 84. The drive circuits 91 to 95, the touch panel 26, and the start/stop switch 29 are connected to the I/O interface 85.

The sewing machine motor 48 is connected to the drive circuit 91. The drive circuit 91 drives the sewing machine motor 48 in accordance with a control signal from the CPU 81. The swinging mechanism 55 is driven via the drive shaft 49 of the sewing machine 1 in accordance with the driving of the sewing machine motor 48, and the needle bar 6 moves up and down. A feed amount adjustment motor 28 is connected to the drive circuit 92. By driving the liquid crystal display (LCD) 15 in accordance with a control signal from the CPU 81, the drive circuit 93 causes an image to be displayed on the LCD 15. The X motor 36 is connected to the drive circuit 94. The Y motor 38 is connected to the drive circuit 95. The drive circuits 94 and 95 respectively drive the X motor 36 and the Y motor 38 in accordance with control signals from the CPU 81. In accordance with the driving of the X motor 36 and the Y motor 38, the embroidery frame 50 mounted on the movement mechanism 40 moves in the left-right direction (the X direction) and the front-rear direction (the Y direction) by a movement amount depending on the control signal.

An example of an operation when the couching pattern is sewn by the sewing machine 1 on which the presser device 2 and the movement mechanism 40 are mounted will be explained with reference to FIG. 1. The user mounts the upper thread and the lower thread on the sewing machine 1 in the same manner as for normal embroidery sewing. The user mounts the embroidery frame 50 holding the sewing object on the movement mechanism 40. The user attaches the presser device 2 to the presser bar 8. Using the jig, the user rotates the adjustment member 4 around a rotation axis extending in the left-right direction, and thus adjusts the position of the insertion hole 60 with respect to the presser bar 8 in the left-right direction. The user hooks the cord C on the thread spool device 10, the guide member 30, and the loop portion 24, and passes the cord C through the insertion hole 60 from above. After selecting pattern data for sewing the couching pattern, the user inputs the sewing start command by selecting the start/stop switch 29. When the sewing start command is acquired, the control portion 80 of the sewing machine 1 drives the movement mechanism 40 and the sewing portion 70 in accordance with the pattern data, and forms the couching pattern on the sewing object C by stitching the cord C onto the sewing object.

The main processing of the sewing machine 1 will be described with reference to FIG. 4 to FIG. 9, using a specific example of sewing a star-shaped couching pattern. In the main processing, processing is executed to sew a pattern onto a sewing object B (refer to FIG. 6) held by the embroidery frame 50, on the basis of the pattern data selected by the user. The main processing is activated when, after the user selects the pattern data, the user inputs the command to start the sewing in accordance with the selected pattern data. When the control portion 80 detects the command to start the sewing, the control portion 80 reads the program for executing the main processing stored in the program storage area in the ROM 82 into the RAM 83. The control portion 80 executes the following steps in accordance with commands included in the program read into the RAM 83. The various parameters necessary for executing the main processing are stored in the flash memory 84. Various pieces of data obtained in the course of the main processing are stored as necessary in the RAM 83. The left-right direction and the up-down direction in FIG. 5 to FIG. 9 correspond, respectively, to the X direction and the Y direction of the embroidery coordinate system.

Figure 4:
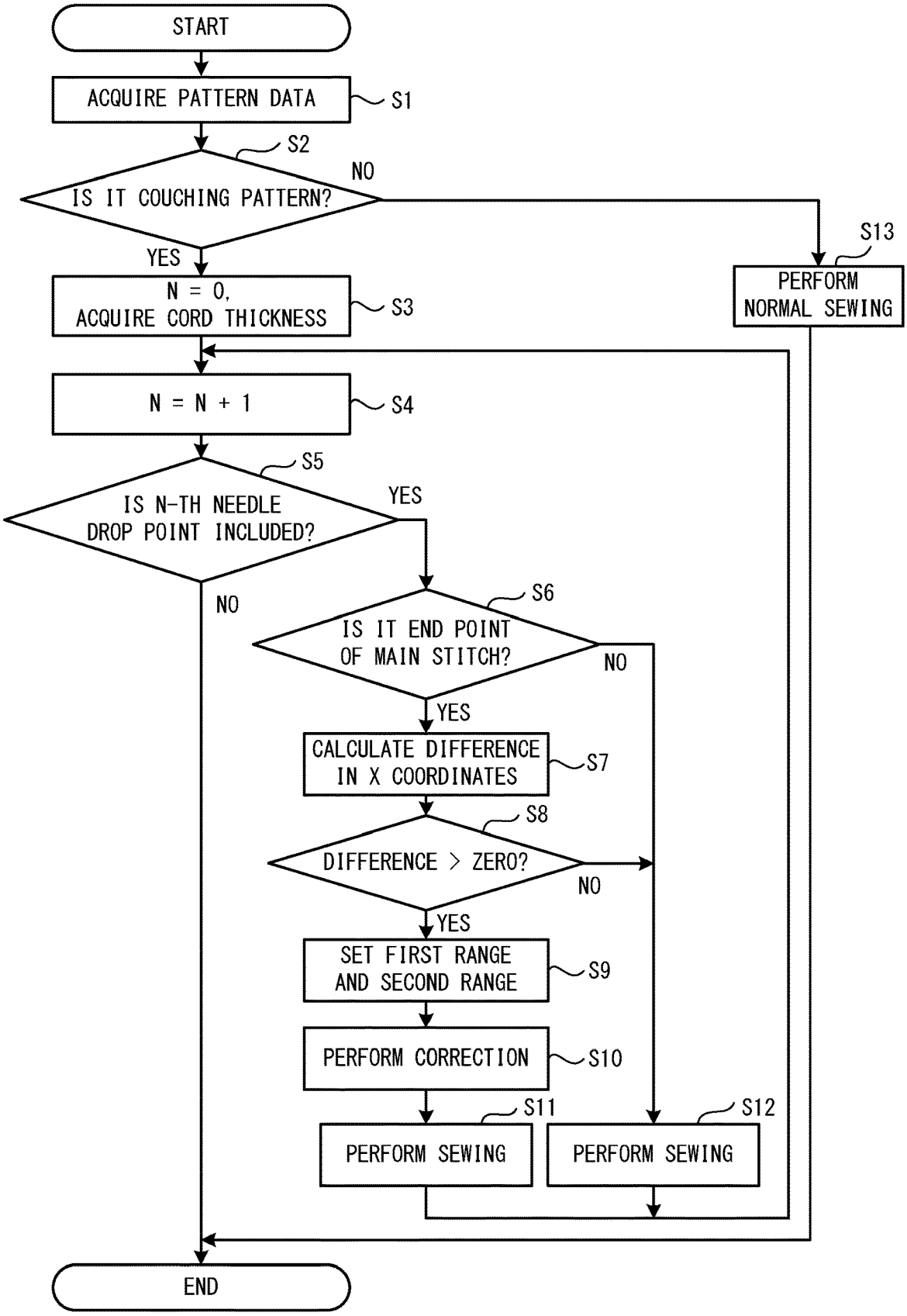
FIG. 4 is a flowchart of main processing.

As shown in FIG. 4, the control portion 80 acquires the pattern data (step S1). The pattern data acquired at step S1 includes data indicating whether or not the pattern data is the pattern data for sewing the couching pattern. The pattern data for sewing the couching pattern is a pattern in which a plurality of motifs are continuously arranged. The motif is configured in a predetermined shape by a plurality of stitches including a main stitch and a sub-stitch. The main stitch has a longest length from among the plurality of stitches of the motif. The sub-stitch has a shorter length than the main stitch and extending in a direction intersecting the main stitch. The pattern data may be data stored in advance in the flash memory 84 or the like, may be generated by the sewing machine 1 using processing that is separately executed, or may be data that is stored in the sewing machine 1 after being generated by an external device.

Figure 5:
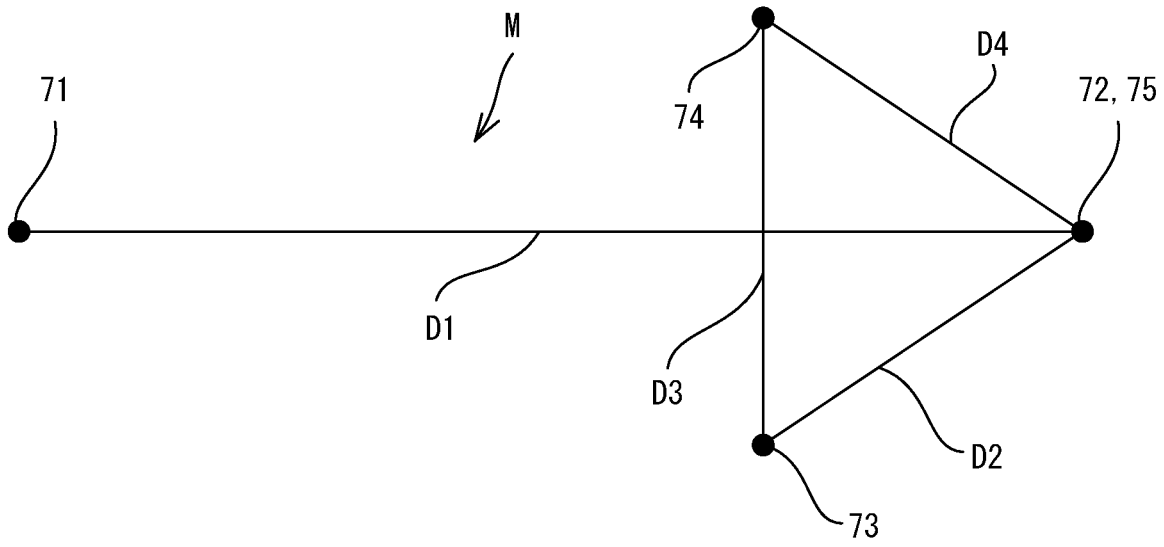
FIG. 5 is an explanatory diagram of a motif.

As shown in FIG. 5, a motif M of a present embodiment is provided with four stitches D1 to D4, in that sewing order. The length of the motif M in a direction along the shape of the couching pattern (an extending direction of the stitch D1) is a size from 2 to 15 mm, for example. The stitch D1 extends from a point 71 to a point 72, and is the main stitch having the longest length among the stitches D1 to D4 of the motif M. The motif M is line symmetrical with respect to the stitch D1. The stitch D2 extends from the point 72 to a point 73. The stitch D3 extends from the point 73 to a point 74. The stitch D3 is the sub-stitch having a shorter length than the stitch D1 and extending in the direction intersecting the stitch D1. Among the lengths of the stitches D1 to D4, the length of the stitch D3 is next longest after the stitch D1. The length of the stitch D3 is shorter than a thickness of the cord C. The stitch D3 orthogonally intersects the stitch D1 on a side closer to the center of the stitch D1 than to the position of the end point 72 of the stitch D1. The center of the stitch D3 is on the stitch D1. The stitch D4 extends from the point 74 to a point 75. The end point 72 of the stitch D1 is the same position as the end point 75 of the stitch D4. The last needle drop point 75 of the one motif M becomes the first needle drop point 71 of the next motif M, that is next after the one motif M in the sewing order. The needle drop points are indicated by the pattern data and are planned positions at which the sewing needle 7 pierces the sewing object.

Figure 6:
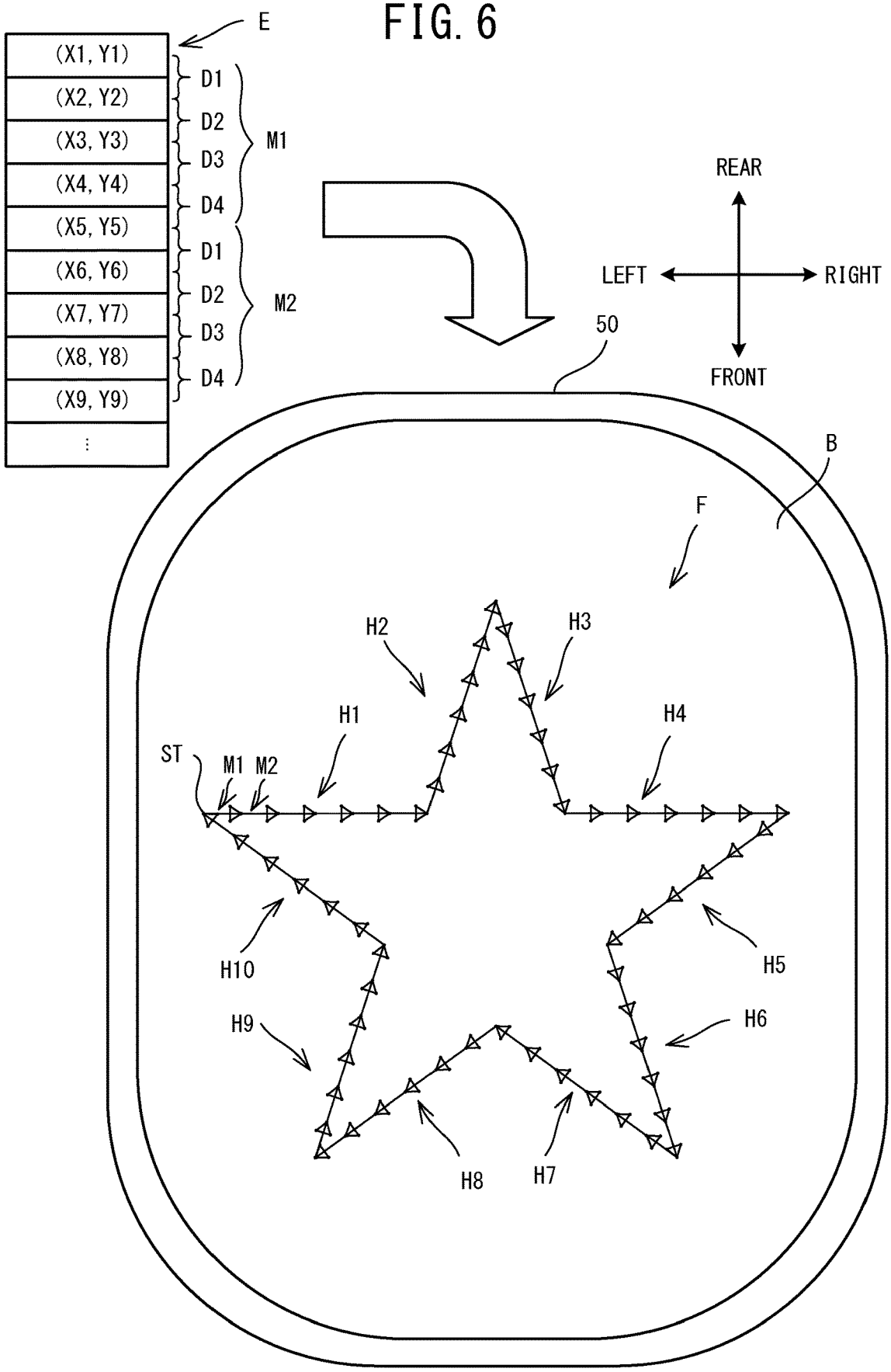
FIG. 6 is an explanatory diagram of pattern data, and a pattern represented by the pattern data.

At step S1, in the specific example, pattern data E shown in FIG. 6 is acquired. As shown in FIG. 6, the pattern data E is represented by an absolute coordinate system of the movement mechanism 40 in the X direction and the Y direction. The pattern data E represents a pattern F in which a plurality of motifs M including a motif M1 and a motif M2 are continuously arranged in the clockwise direction in a plan view along 10 sides H1 to H10 of a star-shaped pattern. The stitches D1 of the motifs M are disposed on the sides H1 to H10. Six of the motifs M are continuously arranged along each of the sides H1 to H10. The size of each of the motifs M is the same. A sewing start point ST of the pattern F is disposed at the left end of the side H1. The pattern F is sewn continuously in the clockwise direction in a plan view from the sewing start point ST.

The control portion 80 determines whether the pattern data E acquired at step S1 is the pattern data for sewing the couching pattern (step S2). When the pattern data acquired at step S1 is not the pattern data for sewing the couching pattern (no at step S2), the control portion 80 drives the movement mechanism 40 and the sewing portion 70 in accordance with the pattern data acquired at step S1 and performs the normal embroidery sewing (step S13). The pattern data E acquired at step S1 is the pattern data for sewing the couching pattern (yes at step S2). In this case, the control portion 80 sets a variable N, which is used to read the needle drop points in order from the pattern data E acquired at step S1, to zero, and acquires the thickness of the cord C (step S3). The thickness of the cord C may be a value that is set in advance, or may be a value that is input by the user. When the sewing machine 1 is provided with an imaging portion (an image sensor or the like), the control portion 80 may detect the thickness of the cord C on the basis of an image captured by the imaging portion and may acquire the detected thickness. The thickness of the cord C is a thickness measured in a state in which tension is not applied to the cord C, for example. The control portion 80 increments the variable N by 1 (step S4). The control portion 80 determines whether an N-th needle drop point is included in the pattern data E acquired at step S1 (step S5).

When the N-th needle drop point is included in the pattern data E acquired at step S1 (yes at step S5), the control portion 80 determines whether the N-th needle drop point is the needle drop point for sewing the end point 72 of the main stitch D1 (step S6). For example, the control portion 80 calculates the length of the stitch on the basis of the position of an (N−1)-th needle drop point and the position of the N-th needle drop point, and performs processing at step S6 on the basis of whether the calculated length is the length of the main stitch D1. In another example, the control portion 80 performs the processing at step S6 on the basis of the value of the variable N. Specifically, when the variable N is a number represented by (4n−2), the control portion 80 determines that the N-th needle drop point is the end point 72 of the main stitch D1. Note that n is a natural number indicating a number of the motifs M from the sewing start point ST. When the pattern data E includes a flag indicating whether the N-th needle drop point is the end point 72 of the main stitch D1, the control portion 80 may determine, on the basis of a value of the flag, whether the N-th needle drop point is the needle drop point for sewing the end point 72 of the main stitch D1.

When the variable N is 1, a first needle drop point is the needle drop point for sewing the start point 71 of the main stitch D1 (no at step S6). In this case, the control portion 80 moves to the N-th needle drop point and performs sewing without correcting the pattern data E acquired at step S1 (step S12). Specifically, the control portion 80 moves the embroidery frame 50 in the X direction and the Y direction using the movement mechanism 40, disposes the N-th needle drop point below the needle bar 6, and drives the swinging mechanism 55 and the shuttle mechanism 56. In this way, the stitch is formed in the sewing object B held by the embroidery frame 50, by the sewing needle 7 mounted on the needle bar 6. The control portion 80 returns the processing to step S4.

When the N-th needle drop point is the needle drop point for sewing the end point 72 of the main stitch D1 (yes at step S6), the control portion 80 calculates a value obtained by subtracting the X coordinate of the (N−1)-th needle drop point from the X coordinate of the N-th needle drop point (step S7). When the N-th needle drop point is the end point 72 of the main stitch D1, the (N−1)-th needle drop point is the needle drop point for sewing the start point 71 of the main stitch D1. In the sewing machine 1 of the present embodiment, the cord C is supplied to the insertion hole 60 from the loop portion 24 that is positioned to the above left, and slightly to the rear of, the insertion hole 60. The sewing machine 1 assumes a supply direction of the cord C to the insertion hole 60, in the two-dimensional coordinates of the embroidery coordinate system, to be the rightward direction, and corrects the N-th needle drop point in accordance with a movement amount of the X coordinate of the N-th needle drop point with respect to the (N−1)-th needle drop point represented by the pattern data E.

The control portion 80 determines whether the difference between the X coordinates calculated at step S7 is larger than zero (step S8). The difference between the X coordinates calculated at step S7 is smaller than zero (no at step S8) for the end point 72 of the main stitch D1 of the motif M disposed on any one selected from the group of the side H5, the side H7, the side H8, and the side H10 of the pattern F shown in FIG. 7C. In this case, the control portion 80 moves to the N-th needle drop point and performs sewing (step S12) without correcting the pattern data E acquired at step S1. The control portion 80 returns the processing to step S4.

Figure 7A:
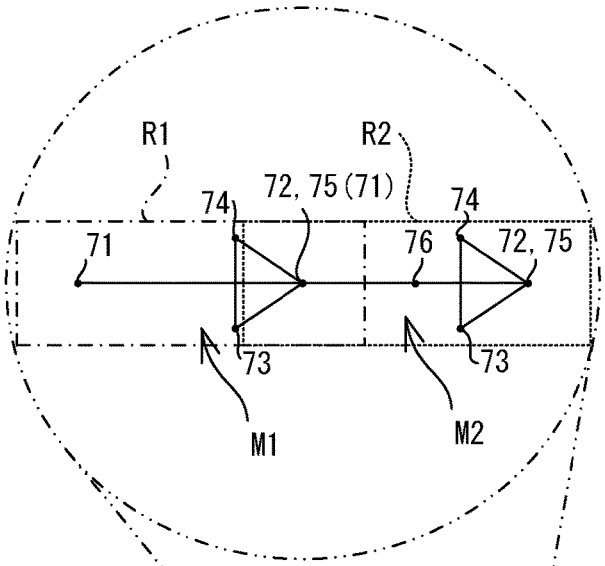
FIG. 7A to FIG. 7C are explanatory diagrams of processing to correct end points of main stitches included in the pattern data.
Figure 7B:
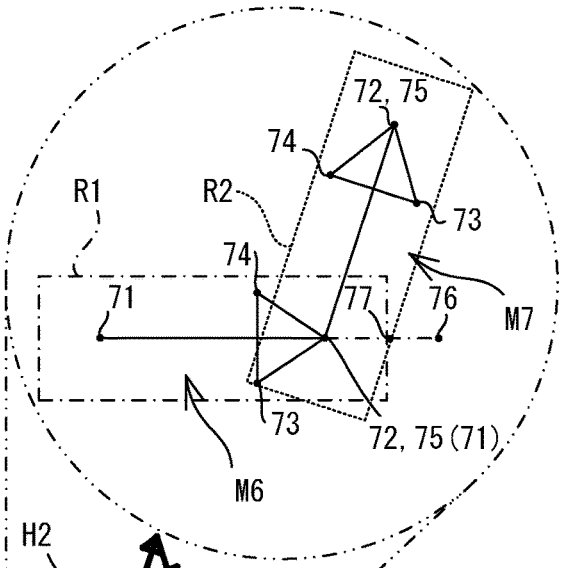
Figure 7C:
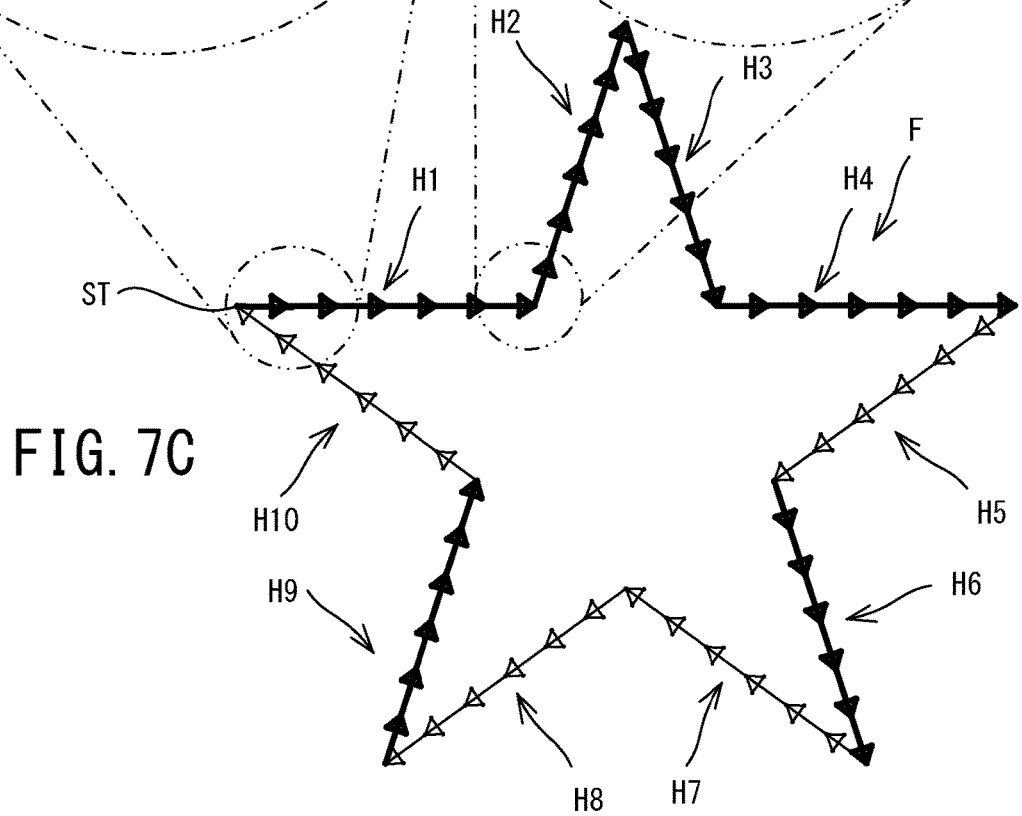

On the other hand, the difference between the X coordinates calculated at step S7 is larger than zero (yes at step S8) for the end point 72 of the main stitch D1 of the motif M disposed on any one selected from the group of the side H1 to the side H4, the side H6, and the side H9 of the pattern F shown in FIG. 7C, which are shown by thicker lines than for the motif M disposed on the side H5. In this case, the control portion 80 sets a first range and a second range (step S9). The first range is a range in which a length from the main stitch D1 of the one motif M is equal to or less than half the thickness of the cord C acquired at step S3. The second range is a range in which a length from the main stitch D1 of the motif M that is next in the sewing order after the one motif M is equal to or less than half the thickness of the cord C acquired at step S3.

When the variable N is 2, for example, as shown in FIG. 7A, a first range R1 is set in which a length from the stitch D1 of the motif M1 that is first in the sewing order is equal to or less than half the thickness of the cord C. The first range R1 is a range surrounded by a one dot chain line. In a similar manner, a second range R2 is set in which a length from the stitch D1 of the motif M2 that is next in the sewing order after the motif M1 is equal to or less than half the thickness of the cord C. The second range R2 is a range surrounded by a dotted line. The first range R1 and the second range R2 are rectangular shapes having sides parallel to the stitch D1. When the variable N is 22, for example, as shown in FIG. 7B, the first range R1 is set in which a length from the stitch D1 of a motif M6 that is sixth in the sewing order is equal to or less than half the thickness of the cord C. In a similar manner, the second range R2 is set in which a length from the stitch D1 of a motif M7 that is next in the sewing order after the motif M6 is equal to or less than half the thickness of the cord C.

The control portion 80 corrects the position of the end point 72 of the main stitch D1 included in the pattern data E such that the length of the main stitch D1 is longer in a second case than in a first case (step S10). The first case is a case in which the position of the end point 72 of the main stitch D1 of the one motif M represented by the pattern data E acquired at step S1 is a position at which the sewing object B has been moved to the right with respect to the needle bar 6, from the position of the start point 71 of the main stitch D1. Specifically, the first case is a case in which it is determined, at step S8, that the difference calculated at step S7 is smaller than zero. The second case is a case in which the position of the end point 72 of the main stitch D1 is a position at which the sewing object B has been moved to the left with respect to the needle bar 6, from the position of the start point 71. Specifically, the second case is a case in which it is determined, at step S8, that the difference calculated at step S7 is larger than zero. After the start of the sewing, after moving to the position of the start point 71 of the main stitch D1, and before moving to the position of the end point 72 of the main stitch D1, the control portion 80 corrects neither the position of the start point 71 nor the position of the end point 72 of the main stitch D1 represented by the pattern data E in the first case, while in the second case, the control portion 80 corrects the position of the end point 72 of the main stitch D1 represented by the pattern data E to be further to the right than the position before the correction. In the second case, the control portion 80 corrects the position, in the left-right direction, of the position of the end point 72 of the main stitch D1, and does not correct the position in the front-rear direction. In other words, the control portion 80 corrects the X coordinate of the N-th needle drop point at step S10, and does not correct the Y coordinate.

Specifically, the control portion 80 corrects the X coordinate of the N-th needle drop point on the basis of the following Expression (1):

$$X(N)=(X(N)-X(N-1))\times K+X(N-1) \quad \text{Expression (1)}$$

X(N) is the X coordinate of the N-th needle drop point, X(N−1) is the X coordinate of the (N−1)-th needle drop point, and K is a correction factor. The correction factor may be determined as appropriate depending on the shape of the motif M, the thickness and the material of the cord C, and the like, may be a value that is determined in advance, or may be a value set by the user. The correction factor is preferably a value larger than 1 and a value equal to or smaller than 2. The control portion 80 corrects the position of at least one selected from the group of the end points 72 of the main stitches D1 included in the pattern data E to a position contained in at least one selected from the group of the first range R1 and the second range R2.

For example, when the variable N is 2 and the correction factor is 1.5, the control portion 80 provisionally corrects the end point 72 to a point 76, as shown in FIG. 7A, on the basis of Expression (1). The point 76 is not contained within the first range R1 but is contained within the second range R2. Thus, the control portion 80 corrects the end point 72 to the point 76 calculated on the basis of Expression (1). When the variable N is 22 and the correction factor is 1.5, the control portion 80 provisionally corrects the end point 72 to the point 76, as shown in FIG. 7B, on the basis of Expression (1). The point 76 is not contained in the first range R1, nor in the second range R2. In this case, the control portion 80 calculates a point 77 that is closest to the point 76, among points at which a line segment joining the start point 71 and the point 76 crosses a boundary of either the first range R1 and the second range R2, and corrects the end point 72 to the calculated point 77.

The control portion 80 moves the embroidery frame 50 in the X direction and the Y direction using the movement mechanism 40, in accordance with the pattern data E corrected at step S10, disposes the post-correction N-th needle drop point below the needle bar 6, and drives the swinging mechanism 55 and the shuttle mechanism 56 (step S11). In this way, the stitch is formed in the sewing object B held by the embroidery frame 50, by the sewing needle 7 mounted on the needle bar 6. The control portion 80 returns the processing to step S4. When the N-th needle drop point is not included in the pattern data E acquired at step S1 (no at step S5), the control portion 80 ends the main processing.

Figures 8A, 8B, 8C, 8D, 8E:
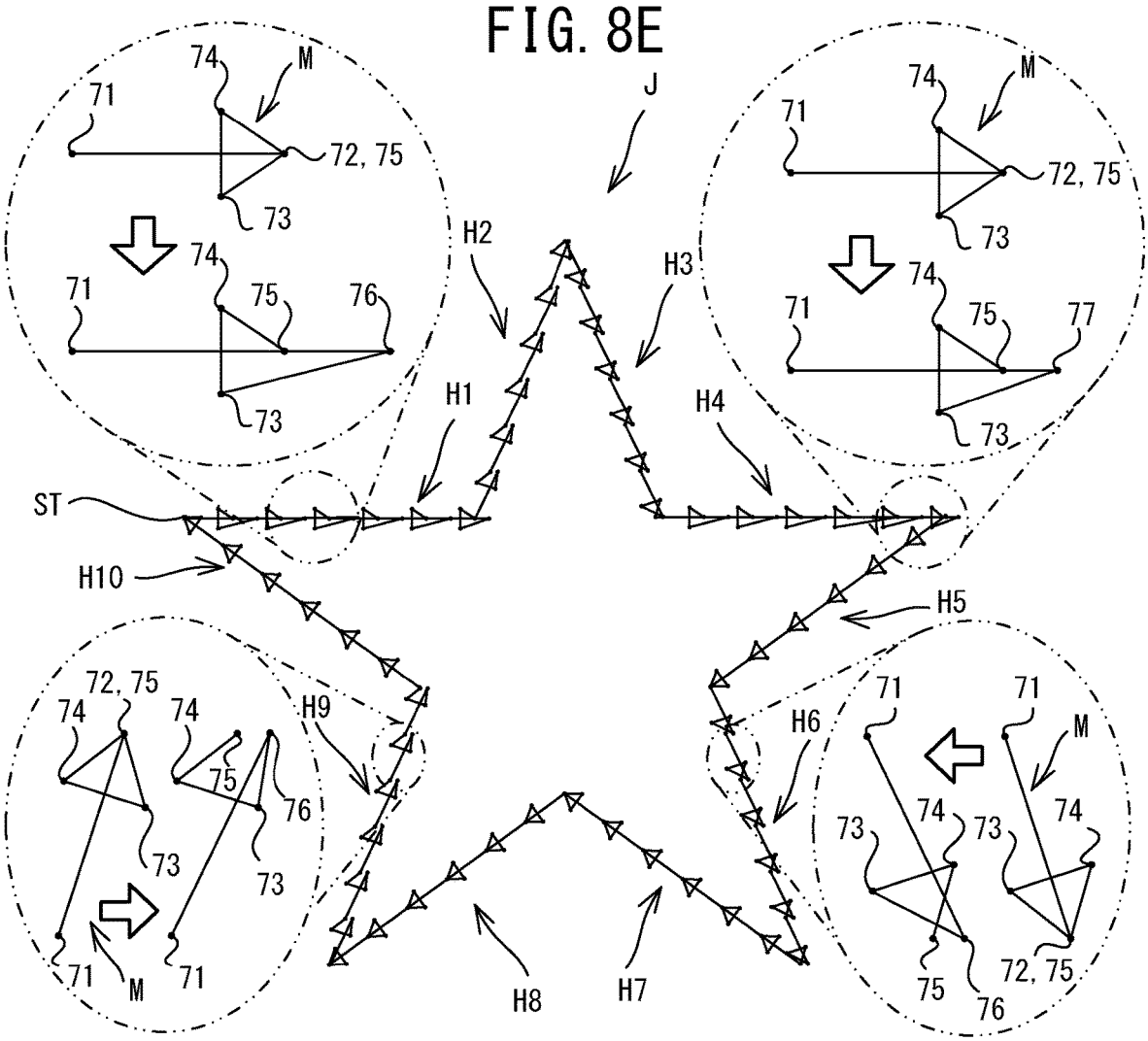
FIG. 8A to FIG. 8E are explanatory diagrams of a pattern corrected by the main processing.
Figure 9:
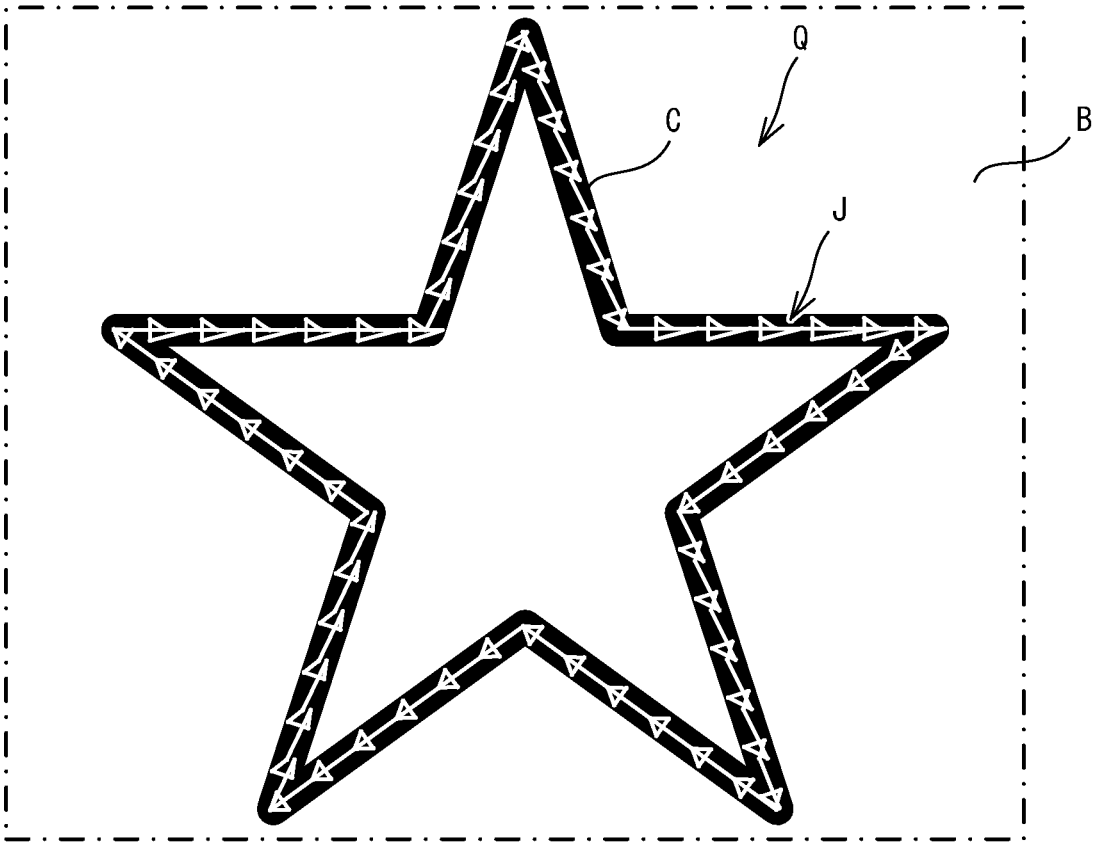
FIG. 9 is an explanatory diagram of a couching pattern sewn by the main processing.

When the correction factor of Expression (1) is 1.5, with respect to the pattern data E, the positions of the end points 72 of the main stitches D1 of the motifs M disposed on the side H1 to the side H4, the side H6, and the side H9 are corrected by the main processing, as represented by a pattern J shown in FIG. 8E. As shown in FIG. 8A, the end points 72 of the main stitches D1 of the motifs M that are first to fifth in the sewing order, among the six motifs M disposed on each of the side H1 to the side H4, are corrected to the points 76 in accordance with Expression (1). As shown in FIG. 8B, the end point 72 of the main stitch D1 of the motif M that is sixth in the sewing order, among the six motifs M disposed on each of the side H1 to the side H4, is corrected to the point 77 described above with reference to FIG. 7B. As shown in FIG. 8C, the end points 72 of the main stitches D1 of all of the motifs M disposed on each of the side H2 and the side H9 are corrected to the points 76 in accordance with Expression (1). As shown in FIG. 8D, the end points 72 of the main stitches D1 of all of the motifs M disposed on each of the side H3 and the side H6 are corrected to the points 76 in accordance with Expression (1). In the motifs M, the points other than the end points 72 of the main stitches D1 are not corrected. Thus, lengths of line segments connecting the positions of each of the start points 71 of any chosen two of the motifs M that are continuous in the sewing order and represented by the pattern data E corrected by the control portion 80 are the same as each other. The post-correction motifs M shown in FIG. 8A to FIG. 8D have mutually different shapes depending on the extending direction of the pre-correction main stitches D1. A couching pattern Q shown in FIG. 9, for example, is formed on the sewing object B by the main processing. In FIG. 9, taking visibility into account, the cord C is indicated by thick black lines and the pattern J is indicated by white lines, but the stitches of the pattern J may be formed by a thread of the same or similar color as that of the cord C. The pattern J is formed on the cord C, and the cord C is stitched to the sewing object B.

In the sewing machine 1 provided with the guide 21 configured to guide the cord C to the insertion hole 60 from the left, the tension applied to the cord C in the second case is greater than in the first case. The control portion 80 of the sewing machine 1 of the above-described embodiment corrects the position of at least one selected from the group of the start point 71 and the end point 72 of the main stitch D1 included in the pattern data E, such that the length of the stitch D1 is longer in the second case than in the first case (step S10). In this way, the sewing machine 1 can suppress differences in a pull-out amount of the cord C when sewing the main stitch D1 depending on the tension applied to the cord C. Thus, the sewing machine 1 can reduce variations in the thickness of the cord C depending on the direction in which the cord C is supplied to the insertion hole 60 and on the feed direction of the sewing object B, and can improve the possibility of the cord C being stitched to the sewing object B.

In the first case (no at step S8), the control portion 80 corrects neither the position of the start point 71 nor the position of the end point 72 of the main stitch D1 represented by the pattern data E, and in the second case (yes at step S8), the control portion 80 corrects the position of the end point 72 of the main stitch D1 represented by the pattern data E so as to be formed further to the right than before the correction (step S10). By correcting the position of the end point 72 of the main stitch D1 in the second case, the sewing machine 1 can reduce variations in the thickness of the cord C depending on the direction in which the cord C is supplied to the insertion hole 60 and on the feed direction of the sewing object B, and can improve the possibility of the cord C being stitched to the sewing object B. The control portion 80 of the present embodiment corrects the position of the end point 72 of the main stitch D1 represented by the pattern data E so as to be formed further to the right than before the correction, after moving to the position of the start point 71 of the main stitch D1, and before moving to the position of the end point 72 of the main stitch D1. Thus, the sewing machine 1 can correct the pattern data E after editing the size, arrangement and the like of the pattern data E and verifying the pattern data E.

The cord C is supplied to the insertion hole 60 from the left side of the insertion hole 60. In the second case, of the positions of the end points 72 of the main stitches D1, the control portion 80 corrects the position in the left-right direction and does not correct the position in the front-rear direction. The sewing machine 1 can correct only the position in the left-right direction which relates to the tension applied to the cord C. Thus, while suppressing a difference between the pattern F represented by the pre-correction pattern data E and the pattern J represented by the post-correction pattern data E from becoming large, the sewing machine 1 can reduce variations in the thickness of the cord C depending on the direction in which the cord C is supplied to the insertion hole 60 and on the feed direction of the sewing object B, and can improve the possibility of the cord C being stitched to the sewing object B.

The lengths of the line segments connecting the positions of each of the start points 71 of any chosen two of the motifs M that are continuous in the sewing order and represented by the pattern data E corrected by the control portion 80 are the same as each other. The sewing machine 1 can maintain the overall shape of the pattern even after the correction of the pattern data E by the control portion 80.

The control portion 80 acquires the thickness of the cord C (step S3). The control portion 80 corrects the position of the end point 72 included in the pattern data E to the position that is contained in at least one selected from the group of the first range R1, which is the range in which the length from the main stitch D1 of the one motif M represented by the pattern data E acquired at step S1 is equal to or less than half the thickness of the cord C, and the second range R2, which is the range in which the length from the main stitch D1 of the motif M that is next in the sewing order after the one motif M is equal to or less than half the thickness of the cord C (step S10). Thus, the sewing machine 1 can reduce the possibility that the post-correction end point 72 of the main stitch D1 is not formed on the cord C.

The control portion 80 corrects the positions of the end points 72 of the main stitches D1 included in the pattern data E, such that the length of the main stitch D1 in the second case is contained within a range that is one to two times the length of the main stitch D1 in the first case. The sewing machine 1 can cause the length of the post-correction main stitch D1 to be contained within the range of one to two times that of the length before correction. Thus, while suppressing a difference between the pattern F represented by the pre-correction pattern data E and the pattern J represented by the post-correction pattern data E from becoming large, the sewing machine 1 can reduce variations in the thickness of the cord C depending on the direction in which the cord C is supplied to the insertion hole 60 and on the feed direction of the sewing object B, and can improve the possibility of the cord C being stitched to the sewing object B.

In the one motif M of the pattern data E acquired at step S1, the sub-stitch D3 orthogonally intersects the main stitch D1 on a side closer to the center of the main stitch D1 than to the position of the end point 72. The center of the sub-stitch D3 is on the main stitch D1. Of the lengths of the plurality of stitches D1 to D4, the length of the sub-stitch D3 is next longest after the length of the main stitch D1. The position of the end point 72 of the main stitch D1 is aligned with the position of the start point 71 of the next motif M that is next after the one motif M in the sewing order. As a result, the sewing machine 1 can stitch the cord C to the sewing object B using the motif M having the relatively simple configuration.

The sewing machine and the sewing machine control method of the present disclosure are not limited to the above-described embodiment, and various modifications may be made without departing from the broad spirit and scope of the present disclosure. For example, the following modifications may be added as appropriate.

(A) The configuration of the sewing machine 1, on which the presser device 2 and the embroidery frame 50 can be mounted, may be changed as appropriate. The sewing machine 1 may be an industrial sewing machine, or a multi-needle sewing machine. It is sufficient that the movement mechanism 40 be capable of moving the holder in the left-right direction and the front-rear direction relative to the needle bar 6. The movement mechanism 40 may be configured integrally with the sewing machine 1. The shape and the size of the embroidery frame 50 may be changed as appropriate, and the shape may be circular, oval or the like, for example. The configuration of the presser device 2 may be changed as appropriate, and the presser device 2 may have a configuration in which the position of the insertion hole 60 cannot be adjusted in the left-right direction with respect to the presser bar 8. The guide 21 may be provided not on the presser device 2 but on the sewing machine 1. The present disclosure can be realized in various modes, such as a program, a non-transitory computer-readable medium, and a sewing system, for example.

(B) The program including the instructions to execute the main processing shown in FIG. 4 may be stored in a storage device of the sewing machine 1 until the program is executed by the control portion 80. Thus, a program acquisition method, an acquisition path, and a device storing the program may be changed, respectively, as appropriate. The program executed by the control portion 80 may be received from another device via cable or wireless communication, and may be stored in a storage device, such as a flash memory or the like. The other device includes a PC, and a server connected via a network, for example.

(C) Each of the steps of the main processing of the sewing machine 1 is not limited to the example of being executed by the control portion 80, and part or all of the processing may be executed by another electronic device (an ASIC, for example). Each of the steps of the main processing may be executed by distributed processing by a plurality of electronic devices (a plurality of CPUs, for example). The order of each of the steps of the main processing may be changed, the step may be omitted, or a step may be added, as necessary. A mode in which part or all of the main processing is executed by an operating system (OS) or the like operated on the sewing machine 1 on the basis of instructions from the control portion 80 is also included in the scope of the present disclosure. For example, the following changes may be added to the main processing as appropriate.

The supply direction of the cord C to the insertion hole 60, which is prescribed by the arrangement of the guide 21 with respect to the insertion hole 60 of the presser device 2, may be changed as appropriate. In this case, the control portion 80 may consider the first case to be a case in which the position of the end point 72 of the main stitch D1 of the one motif M is a position obtained by moving the sewing object B from the position of the start point 71 of the main stitch D1 in the supply direction of the cord C with respect to the needle bar 6, and may consider the second case to be a case in which the end point position is a position obtained by moving the sewing object B from the start point position in the opposite direction to the supply direction of the cord C with respect to the needle bar 6. For example, the supply direction of the cord C may be the left side, the rear side, and the front side of the insertion hole 60. The cord C need not necessarily be supplied to the insertion hole 60 from strictly the left side. For example, the main processing may be performed in a case in which the cord C is supplied from the left side with respect to the insertion hole 60, when, in terms of an angle in the clockwise direction in a plan view of the two-dimensional coordinate system when the positive X direction is taken as a reference (zero degrees), the loop portion 24 that guides the cord C is within a range of 135 degrees to 225 degrees with respect to the insertion hole 60. In the main processing, the control portion 80 may acquire the supply direction of the cord C to the insertion hole 60 of the presser device 2 that is input by the user, and may perform the processing from step S7 to step S10 after setting the first case and the second case in accordance with the acquired supply direction.

When the supply direction of the cord C to the insertion hole 60 of the presser device 2, which accords with the arrangement of the guide 21 with respect to the insertion hole 60 of the presser device 2, is not aligned with one of the axial directions in the coordinate system of the movement mechanism 40, the control portion 80 may set a supply coordinate system on the basis of the supply direction of the cord C to the insertion hole 60, and may convert the coordinates of the needle drop points represented by the coordinate system of the movement mechanism 40 to coordinates represented by the supply coordinate system, and may perform the main processing. In the supply coordinate system, for example, the supply direction of the cord C to the insertion hole 60 is set as the positive X direction of the supply coordinate system. In this case, for example, between step S6 and step S7, the control portion 80 performs processing to convert the coordinates of the needle drop points represented by the embroidery coordinate system to coordinates represented by the supply coordinate system, and performs the processing from step S7 to step S10 using the coordinates represented by the supply coordinate system. Between step S10 and step S11, the control portion 80 performs processing to convert the coordinates represented by the supply coordinate system to the coordinates of the needle drop points represented by the embroidery coordinate system, and performs the processing at step S11 on the basis of the converted coordinates of the needle drop points represented by the coordinate system of the movement mechanism 40. In this type of case, using relatively simple processing, the sewing machine 1 can reduce variations in the thickness of the cord C depending on the direction in which the cord C is supplied to the insertion hole 60 and on the feed direction of the sewing object B, and can improve the possibility of the cord C being stitched to the sewing object B.

Figure 10A:
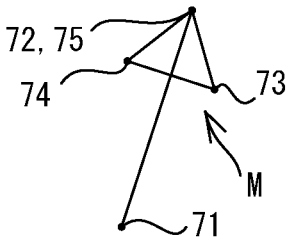
FIG. 10A shows a motif M before correction.
Figure 10B:
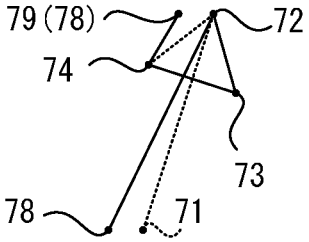
FIG. 10B to FIG. 10D are diagrams showing a motif after correction when a correction factor is 1.5.
Figure 10C:
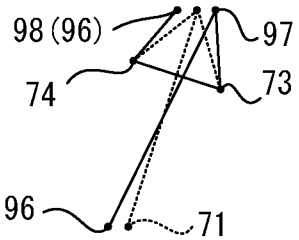
Figure 10D:
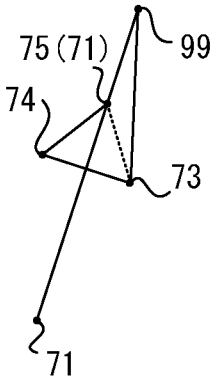

A modified example of processing to correct at least one selected from the group of the end point position and the start point position included in the pattern data E, so that the length of the main stitch is longer in the second case than in the first case, will be explained with reference to FIG. 10A to FIG. 10D. FIG. 10A to FIG. 10D are diagrams corresponding to FIG. 8C, and FIG. 10A shows the pre-correction motif M. In FIG. 10B to FIG. 10D, the post-correction motif when the correction factor is 1.5 is shown by solid lines, and the pre-correction motif M is shown by dotted lines. In the first case, the control portion 80 may correct neither the position of the start point 71 nor the position of the end point 72 represented by the pattern data E, and in the second case, as shown in FIG. 10B, the control portion 80 may correct the position of the start point 71 represented by the pattern data E to a point 78 that is further to the left than before the correction. The point 75 is the start point of the main stitch of the next motif in the sewing order, and the post-correction motif includes the point 78, the points 73 to 74, and a point 79, in that sewing order. As shown in FIG. 10C, in the first case, the control portion 80 may correct neither the position of the start point 71 nor the position of the end point 72 represented by the pattern data E, and in the second case, the control portion 80 may correct the position of the start point 71 represented by the pattern data E to a point 96 that is further to the left than before the correction, and may correct the position of the end point 72 represented by the pattern data E to a point 97 that is further to the right than before the correction. The post-correction motif includes the point 96, the point 97, the point 73, the point 74, and a point 98, in that sewing order. Of the end point positions, the control portion 80 may correct at least one selected from the group of the position in a first direction, and the position in a second direction. As shown in FIG. 10D, in the first case, the control portion 80 may correct neither the position of the start point 71 nor the position of the end point 72 represented by the pattern data E, and in the second case, with respect to the end point 72 represented by the pattern data E, the control portion 80 may correct both the position in the left-right direction and the position in the front-rear direction, and may perform the correction further in an extending direction of the main stitch than before the correction. The post-correction motif includes the point 71, a point 99, and the point 73 to the point 75, in that sewing order.

At step S10, in the first case, the control portion 80 may correct at least one selected from the group of the start point position and the end point position of the main stitch represented by the pattern data E, and in the second case, the control portion 80 may correct neither the start point position nor the end point position of the main stitch represented by the pattern data E. The control portion 80 may omit the processing at step S11 and step S12, and, when the N-th needle drop point is not included in the pattern data E acquired at step S1 (no at step S5), by performing the sewing in accordance with the corrected pattern data E, the control portion 80 may perform the processing to correct the pattern data E after acquiring the sewing start command, and before sewing the sewing start point. The control portion 80 may correct a position of a point other than the start point position and the end point position of the main stitch included in the motif, and lengths of line segments connecting the start point positions of any chosen two of the motifs that are continuous in the sewing order and represented by the corrected pattern data E may be different from each other. The processing at step S3 to acquire the thickness of the cord C may be omitted. The control portion 80 may correct at least one selected from the group of the start point position and the end point position of the main stitch to a position that is not contained within at least one selected from the group of the first range R1 and the second range R2. The shape of the first range and the second range may be changed as appropriate, and for example, end portions of the first range and the second range may be arc shapes having a radius that is half of the cord C, centered on the start point or the end point of the main stitch. The first range and the second range may be ranges in which a length from the main stitch is equal to or less than a predetermined value. The predetermined value may be, for example, a value that is ¼ to ½ the thickness of the cord C. The shape, the number of stitches, the size, and the like of the motif M may be changed as appropriate.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a movement mechanism configured to move a sewing object in a first direction and a second direction orthogonal to the first direction;

a swinging mechanism including a needle bar having a lower end on which a sewing needle is mountable, and configured to swing the needle bar in a third direction orthogonal to the first direction and the second direction;

a presser device including an insertion hole through which the sewing needle is insertable;

a guide portion configured to guide a cord to the insertion hole from one side in the first direction;

a processor configured to control the movement mechanism and the swinging mechanism; and a memory configured to store computer-readable instructions that, when executed by the processor, instruct the processor to perform processes comprising:

acquiring pattern data that is used for sewing a couching pattern in which the cord inserted through the insertion hole is stitched to the sewing object, and that represents positions of a plurality of needle drop points, the couching pattern being a pattern in which a plurality of motifs are continuously arranged, each motif of the plurality of motifs being configured in a predetermined shape by a plurality of stitches including a main stitch and a sub-stitch, the main stitch having a longest length from among the plurality of stitches of the respective motif, the sub-stitch having a length shorter than that of the main stitch and extending in a direction intersecting the main stitch, and the pattern data being represented using a coordinate system of the movement mechanism in the first direction and the second direction;

correcting at least one selected from the group of a start point position and an end point position of the main stitch of one of the plurality of motifs included in the pattern data, such that the length of the main stitch of the one motif, among the plurality of motifs represented by the acquired pattern data, is longer in a second case than in a first case, the first case being a case in which the end point position is a position obtained by moving the sewing object from the start point position toward another side in the first direction with respect to the needle bar, and the second case being a case in which the end point position is a position obtained by moving the sewing object from the start point position toward the one side in the first direction with respect to the needle bar; and driving the movement mechanism and the swinging mechanism in accordance with the corrected pattern data to sew the couching pattern.

2. The sewing machine according to claim 1, wherein the correcting the at least one selected from the group of the start point position and the end point position included in the pattern data includes in the first case, not correcting either of the start point position and the end point position represented by the pattern data, and in the second case, correcting the end point position represented by the pattern data further to the other side in the first direction than before the correction.

3. The sewing machine according to claim 2, wherein the correcting the at least one selected from the group of the start point position and the end point position included in the pattern data includes in the second case, with respect to the end point position, correcting the position in the first direction and not correcting the position in the second direction.

4. The sewing machine according to claim 2, wherein lengths of line segments connecting start point positions of any chosen two of the motifs that are continuous in a sewing order and represented by the corrected pattern data are the same as each other.

5. The sewing machine according to claim 2, wherein the computer-readable instructions further instruct the processor to perform processes comprising:

acquiring a thickness of the cord, and the correcting the at least one selected from the group of the start point position and the end point position included in the pattern data includes correcting the at least one selected from the group of the start point position and the end point position included in the pattern data to a position that is contained within at least one selected from the group of a first range and a second range, the first range being a range in which a length from the main stitch of the one motif represented by the acquired pattern data is equal to or less than half the thickness, and the second range being a range in which a length from the main stitch of a motif that is next in a sewing order after the one motif is equal to or less than half the thickness.

6. The sewing machine according to claim 1, wherein the correcting the at least one selected from the group of the start point position and the end point position included in the pattern data includes correcting the at least one selected from the group of the start point position and the end point position included in the pattern data such that the length of the main stitch in the second case is contained in a range that is 1 to 2 times the length of the main stitch in the first case.

7. The sewing machine according to claim 1, wherein in the one motif of the acquired pattern data, the sub-stitch orthogonally intersects the main stitch on a side closer to a center of the main stitch than to the end point position, a center of the sub-stitch is on the main stitch, of lengths of the plurality of stitches, the length of the sub-stitch is next longest after the length of the main stitch, and the end point position of the main stitch is aligned with the start point position of a motif that is next in a sewing order after the one motif.

8. A sewing machine control method for a sewing machine including a movement mechanism configured to move a sewing object in a first direction and a second direction orthogonal to the first direction, a swinging mechanism including a needle bar having a lower end on which a sewing needle is mountable, and configured to swing the needle bar in a third direction orthogonal to the first direction and the second direction, a presser device including an insertion hole through which the sewing needle is insertable, a guide portion configured to guide a cord to the insertion hole from one side in the first direction, and a processor configured to control the movement mechanism and the swinging mechanism, the sewing machine control method comprising the steps of:

acquiring pattern data that is used for sewing a couching pattern in which the cord inserted through the insertion hole is stitched to the sewing object, and that represents positions of a plurality of needle drop points, the couching pattern being a pattern in which a plurality of motifs are continuously arranged, each motif of the plurality of motifs being configured in a predetermined shape by a plurality of stitches including a main stitch and a sub-stitch, the main stitch having a longest length from among the plurality of stitches of the respective motif, the sub-stitch having a length shorter than that of the main stitch and extending in a direction intersecting the main stitch, and the pattern data being represented using a coordinate system of the movement mechanism in the first direction and the second direction;

correcting at least one selected from the group of a start point position and an end point position of the main stitch of one of the plurality of motifs included in the pattern data, such that the length of the main stitch of the one motif, among the plurality of motifs represented by the acquired pattern data, is longer in a second case than in a first case, the first case being a case in which the end point position is a position obtained by moving the sewing object from the start point position toward another side in the first direction with respect to the needle bar, and the second case being a case in which the end point position is a position obtained by moving the sewing object from the start point position toward the one side in the first direction with respect to the needle bar; and driving the movement mechanism and the swinging mechanism in accordance with the corrected pattern data to sew the couching pattern.

9. The sewing machine control method according to claim 8, wherein the correcting the at least one selected from the group of the start point position and the end point position included in the pattern data includes in the first case, not correcting either of the start point position and the end point position represented by the pattern data, and in the second case, correcting the end point position represented by the pattern data further to the other side in the first direction than before the correction.

10. The sewing machine control method according to claim 9, wherein the correcting the at least one selected from the group of the start point position and the end point position included in the pattern data includes in the second case, with respect to the end point position, correcting the position in the first direction and not correcting the position in the second direction.

11. The sewing machine control method according to claim 9, wherein lengths of line segments connecting start point positions of any chosen two of the motifs that are continuous in a sewing order and represented by the corrected pattern data are the same as each other.

12. The sewing machine control method according to claim 9, further comprising the step of:

acquiring a thickness of the cord, and wherein the correcting the at least one selected from the group of the start point position and the end point position included in the pattern data includes correcting the at least one selected from the group of the start point position and the end point position included in the pattern data to a position that is contained within at least one selected from the group of a first range and a second range, the first range being a range in which a length from the main stitch of the one motif represented by the acquired pattern data is equal to or less than half the thickness, and the second range being a range in which a length from the main stitch of a motif that is next in a sewing order after the one motif is equal to or less than half the thickness.

13. The sewing machine control method according to claim 8, wherein the correcting the at least one selected from the group of the start point position and the end point position included in the pattern data includes correcting the at least one selected from the group of the start point position and the end point position included in the pattern data such that the length of the main stitch in the second case is contained in a range that is 1 to 2 times the length of the main stitch in the first case.

14. The sewing machine control method according to claim 8, wherein in the one motif of the acquired pattern data, the sub-stitch orthogonally intersects the main stitch on a side closer to a center of the main stitch than to the end point position, a center of the sub-stitch is on the main stitch, of lengths of the plurality of stitches, the length of the sub-stitch is next longest after the length of the main stitch, and the end point position of the main stitch is aligned with the start point position of a motif that is next in a sewing order after the one motif.

* * * * *